United States Patent [19]

Fisher

[11] 3,954,332

[45] May 4, 1976

[54] REPRODUCTION MACHINE WITH IMPROVED TRANSFER ROLL

[75] Inventor: Donald J. Fisher, Pittsford, N.Y.

[73] Assignee: Xerox Corporation, Stamford, Conn.

[22] Filed: Jan. 10, 1975

[21] Appl. No.: 540,301

[52] U.S. Cl. ..... 355/3 R; 355/30

[51] Int. Cl.[2] ..... G03G 15/22

[58] Field of Search ..... 355/3 TR, 3 R, 30; 96/1.4; 118/637

[56] References Cited

UNITED STATES PATENTS

| | | | |
|---|---|---|---|
| 3,591,276 | 7/1971 | Byrne | 355/3 TR |
| 3,634,007 | 1/1972 | Verderber et al. | 355/3 R |
| 3,677,632 | 7/1972 | MacDonald | 355/3 R |
| 3,685,896 | 8/1972 | Kaupp | 355/3 TR |
| 3,781,105 | 12/1973 | Meagher | 355/3 TR |
| 3,837,741 | 9/1974 | Spencer | 355/3 R |
| 3,877,416 | 4/1975 | Donohue et al. | 118/637 |
| 3,893,761 | 7/1975 | Buchan et al. | 355/3 TR |

FOREIGN PATENTS OR APPLICATIONS

| | | |
|---|---|---|
| 45-21339 | 8/1970 | Japan |

*Primary Examiner*—L. T. Hix
*Assistant Examiner*—Kenneth C. Hutchison
*Attorney, Agent, or Firm*—Bernard A. Chiama; Earl T. Reichert

[57] ABSTRACT

Apparatus is provided for heating an electrically biased transfer roll in an electrostatic reproduction machine so as to improve the transfer of a developed electrostatic image from a photoreceptor to a transfer member during operation of the machine. The roll is heated to maintain the resistivity thereof within a range which will effect optimum transfer, and to overcome the detrimental effects of ambient conditions such as humidity changes on the resistivity.

4 Claims, 3 Drawing Figures

REPRODUCTION MACHINE WITH IMPROVED TRANSFER ROLL

BACKGROUND OF THE INVENTION

This invention relates generally to an improved electrically biased transfer roll for an electrostatic reproduction machine. More particularly, the invention relates to a transfer roll having apparatus for heating the roll so as to improve the transfer of a developed image from a photoreceptor to a support member such as a sheet of paper during operation of the machine.

In the practice of xerography as described in U.S. Pat. No. 2,297,691 of Chester F. Carlson, a xerographic surface comprising a layer of photoconductive insulating material affixed to a conductive backing is used to support electrostatic images. In the usual method of carrying out the process, the xerographic plate (photoreceptor) is electrostatically charged uniformly over its surface, and then exposed to a light pattern of the image being reproduced to thereby discharge the charge in the areas where light strikes the layer. The undischarged areas of the layer thus form an electrostatic charge pattern or electrostatic latent image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being produced. The powder image is subsequently transferred to a sheet of paper or other transfer member, and suitably affixed thereto to form a permanent copy.

The latest concept for electrostatic reproduction machines utilizes high speed flash exposure of the document, and a moving photoconductive material in the form of an endless belt which is continuously charged. Additionally, such reproduction machines are provided with a developing system which supplies toner particles in relatively large quantities for solid area coverage, such as a magnetic brush developing apparatus. Thus, after the belt passes the magnetic brush assembly, for example, a xerographic powder image is formed on the belt which corresponds to the electrostatic latent image. This powder image is then transferred to a support member (e.g., a sheet of paper) to which it is fused by a fusing assembly whereby the powder image is caused to adhere to the support surface permanently.

The latest electrostatic reproduction machines are high speed machines which print copies at a rate substantially in excess of any previous electrostatic reproduction machines, and are intended to compete with other types of printing machines, e.g., offset printing machines. Because of this, it is desired that the quality of the copies made, be extremely high. Important to high quality copies is an effective transfer apparatus for transferring the developed image from the photoreceptor to the support member. It has been found that humidity is a variable factor affecting the resistivity of the transfer roll, and that the transfer operation is very sensitive to the resistivity of the roll, but fairly insensitive to the resistivity of the paper. A substantial dependence of copy quality on relative humidity has been verified. Since the resistivity of the urethane bias roll material changes with the relative humidity, it is very difficult to have an effective working transfer roll.

SUMMARY OF THE INVENTION

It is an object of the present invention to effect optimum level transfer by maintaining the roll at a temperature which will maintain the resistivity of the roll at a value which will effect that level of transfer.

The invention is directed to an improved transfer roll having apparatus for heating the roll, the apparatus comprising suitable means for maintaining the roll at a desired temperature. Preferred embodiments of such apparatus include (1) a heater such as a conventional quartz heating lamp located within the roll along the axis of rotation of the roll, and (2) an electrically conductive coating such as AQUADAG painted on a conductive substrate of the transfer roll, which coating will heat up when subjected to an electric current.

DETAILED DESCRIPTION OF THE INVENTION

Figure 1:
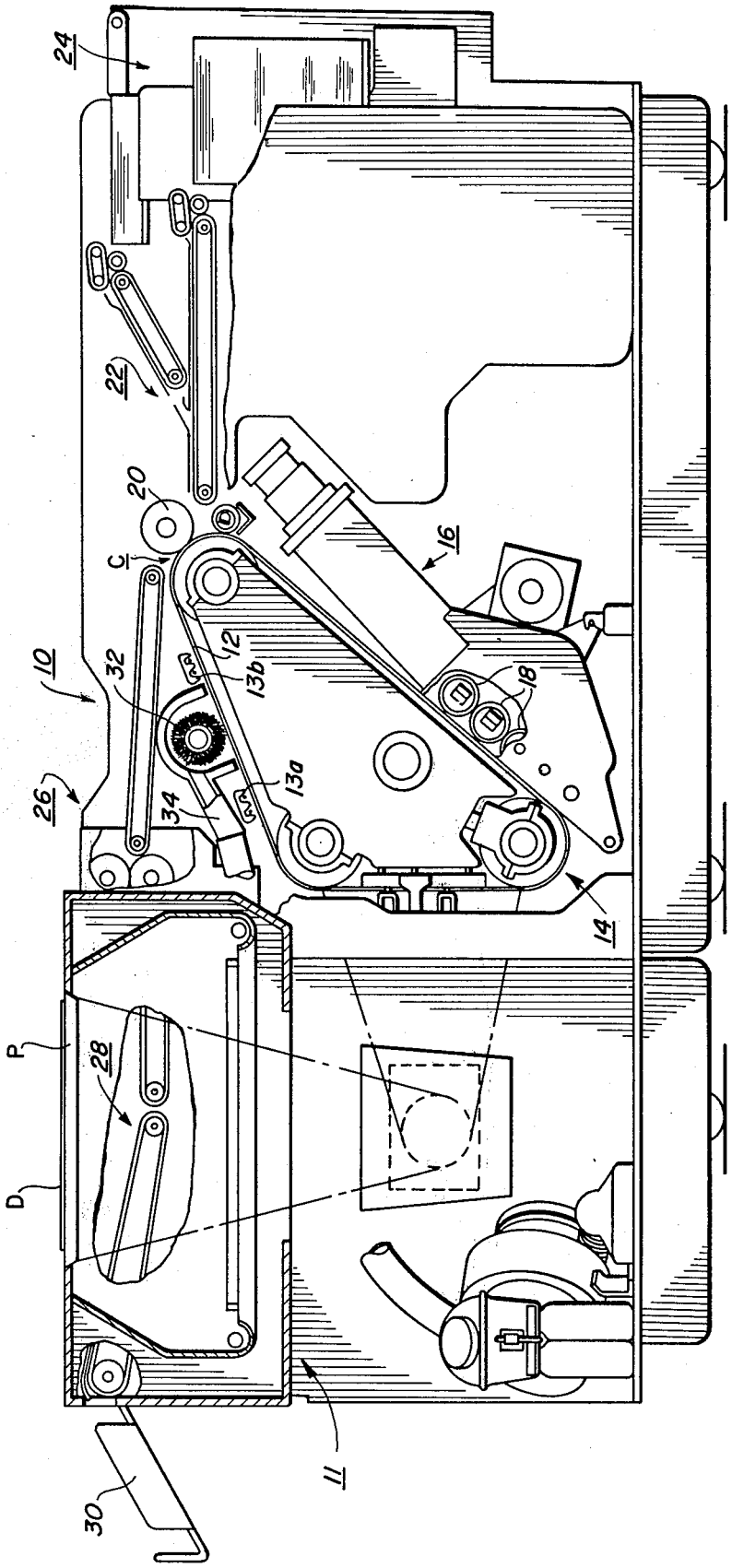
FIG. 1 is a schematic sectional view of an electrostatic reproduction machine embodying the principles of the present invention.

For a general understanding of an electrostatic reproduction machine in which the invention may be incorporated, reference is made to FIG. 1 in which the various system components for the machine are schematically illustrated. As in all electrostatic systems of the type illustrated, a light image of a document to be reproduced is projected onto the sensitized surface of a xerographic plate to form an electrostatic latent image thereon. Thereafter, the latent image is developed with an oppositely charged developing material to form a xerographic powder image corresponding to the latent image on the plate surface. The powder image is then electrostatically transferred to a support surface to which it may be fused by a fusing device whereby the powder image is caused to adhere permanently to the support surface.

In the illustrated machine 10, an original document D to be copied is placed upon a transparent support platen P fixedly arranged in an illumination assembly indicated generally by the reference number 11, arranged at the left end of the machine; a platen cover (not shown) is then lowered onto the original D to cover the same. While upon the platen P, an illumination system flashes light rays upon the original thereby producing image rays corresponding to the informational areas of the original. The image rays are projected by means of an optical system for exposing the photosensitive surface of the xerographic plate or photoreceptor in the form of a flexible photoconductive belt (photoreceptor) 12. The surface of the belt was made photoconductive by the previous step of uniformly charging the same by means of a corona generating device 13. In order to effect image processing, the belt 12 is arranged on a belt assembly indicated generally by the reference numeral 14.

The photoconductive belt assembly 14 is slidably mounted upon two support shafts, one of which is secured to the frame of the machine, and is adapted to drive a belt 12 in the direction of the arrow at a constant rate. During this movement of the belt, the refelcted light image of an original on the platen is flashed upon the surface of the belt to produce electrostatic latent images thereon at an exposure station A.

As the belt surface continues its movement, the electrostatic latent image passes through a developing station B in which there is positioned a developer indicated generally by the reference numeral 16. This developer provides development of the electrostatic latent image by magnetic brushes 18.

The developed electrostatic image is then transported by the belt to a transfer station C where a sheet of copy paper is moved between a transfer roll 20 and the belt at a speed in synchronism with the moving belt in order to effect transfer of the developed image. Such a transfer roll conventionally includes a conductive substrate connected to a power source with one or more layers of elastomeric material surrounding the substrate. When a sheet of paper passes between the transfer roll and photoreceptor, a high electrical field is generated to transfer the toner from the photoreceptor to the paper. There is provided at this station a sheet transport mechanism indicated generally by the numeral 22 which is adapted to transport sheets of paper from a paper handling mechanism indicated generally by the reference numeral 24 to the developed image on the belt at station C.

After the developed image is transferred to the sheet, the latter is stripped from the belt 12 and conveyed into a fuser assembly indicated generally by the reference numeral 26 where the developed and transferred xerographic powder image on the sheet is permanently affixed thereto. After each copy is thus produced, it is delivered via sheet transport mechanism 28 to an output tray 30.

After the image has been transferred at the transfer station C, the belt then moves past a corona generating device 32 where the residual background for the residual toner particles are loosened as a result of an appropriate charge being placed on the residual toner by the corona generating device **13*b*. The residual toner may then be more easily removed by a cleaner brush 32 after which the toner is removed by the vacuum duct 34.**

Additional details regarding the subject electrostatic reproduction machine are set forth in a copending U.S. patent application, Ser. No. 312,411, assigned to the same assignee. Although not specifically discussed herein, it is understood that the present invention may also be used in other types of electrostatic copying or duplicating machine, and is not limited to the high speed duplicating machine disclosed herein.

Figure 2:
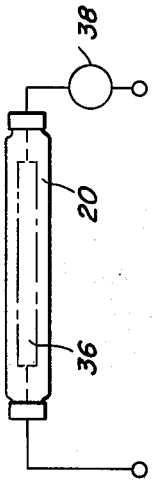
FIG. 2 is a schematic drawing of a first embodiment of the invention showing a transfer roll with a heater located along the axis of the roll.

Referring to FIG. 2, a schematic view of one embodiment of the invention is shown. Located within the transfer roll 20 along the axis of rotation thereof is a heater 36 such as a quartz lamp. If the heater is mounted to rotate with the transfer roll, a conventional slip ring arrangement may be used to supply power to the heater. If it is desired that the heater not rotate with the transfer roll, the latter may include a hollow shaft through which electrical connections to a power supply may be located. To maintain the temperature at a value which will maintain the resistivity of the roll at the desired level, a thermostat 38 is utilized, the thermostat being suitably located within the roll 20, or adjacent to the periphery of the roll, e.g., at the pre-nip area.

Figure 3:
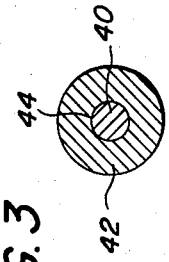
FIG. 3 is a cross-sectional view of a second embodiment of the invention showing a conductive substrate on which the electrically conductive coating is painted.

Another arrangement for heating the transfer roll is shown in FIG. 3. The conductive substrate 40 is connected to a suitable electric energy source to generate the desired electrical field. Surrounding the substrate 20 is an elastomeric layer 42 which contacts the sheet of paper or other transfer member during the transfer operation. To heat this transfer roll, the periphery 44 of the substrate is coated with an electrically conductive coating such as AQUADAG; such a coating heats up when subjected to an electric current. The temperature is controlled in the same manner as the embodiment shown in FIG. 2, i.e., with a thermostat.

Thus, as can be seen, the present invention provides for improving transfer by maintaining the resistivity of the roll within the desired range by heating the transfer roll and maintaining the temperature at a value which will maintain the desired resistivity range. Thus, the resistivity of the transfer roll can be maintained in spite of a variable ambient condition or factor which would normally detrimentally affect the resistivity, and consequently detrimentally affect the transfer operation.

While the invention has been described with reference to the structure disclosed, it is not confined to the details set forth, but is intended to cover such modifications or changes as may come within the scope of the following claims.

What is claimed is:

1. An electrostatic reproduction machine having a photoreceptor, means for producing a developed electrostatic image on the photoreceptor, and an improved electrically biased transfer roll for transferring the image from the photoreceptor to a support member during operation of the machine, the improvement comprising means for maintaining the resistivity of the roll within a desired range during operation of the machine.

2. An electrostatic reproduction machine according to claim 1, wherein the resistivity maintaining means comprises means for heating the roll to a desired temperature and maintaining the roll at that temperature.

3. An electrostatic reproduction machine according to claim 2, wherein the heating means comprises a heater located with the roll.

4. An electrostatic reproduction machine according to claim 2, wherein the transfer roll includes a conductive substrate, and the heating means includes an electrically conductive coating on the substrate, which coating heats up when subjected to an electrical current.

* * * * *